United States Patent [19]

Kibby

[11] 3,975,187

[45] Aug. 17, 1976

[54] TREATMENT OF CARBOTHERMICALLY PRODUCED ALUMINUM

[75] Inventor: Robert M. Kibby, Richmond, Va.

[73] Assignee: Reynolds Metals Company, Richmond, Va.

[22] Filed: Sept. 9, 1975

[21] Appl. No.: 611,794

Related U.S. Application Data

[63] Continuation-in-part of Ser. No. 549,791, Feb. 13, 1975, abandoned, which is a continuation of Ser. No. 324,890, Jan. 18, 1973, abandoned.

[52] U.S. Cl. ..... 75/10 R; 75/63; 75/68 A; 75/93 E

[51] Int. Cl.[2] ..... C22B 21/02

[58] Field of Search ..... 75/10 R, 68 RA, 93 R, 75/93 E, 93 AC, 63

[56] References Cited

UNITED STATES PATENTS

| | | | |
|---|---|---|---|
| 1,019,965 | 8/1912 | Kelly | 75/93 E |
| 1,034,786 | 8/1912 | Greene | 75/93 E X |
| 1,847,555 | 3/1932 | Frary | 75/93 E |
| 2,054,923 | 9/1936 | Betterton et al. | 75/93 E |
| 2,160,812 | 6/1939 | Alden et al. | 75/93 E |
| 2,369,213 | 2/1945 | Cooper | 75/93 E |
| 2,380,863 | 7/1945 | Nelson et al. | 75/93 E |
| 2,506,598 | 5/1950 | Johnson | 75/93 E X |
| 3,087,808 | 4/1963 | Gottschalk | 75/68 R |
| 3,149,960 | 9/1964 | Robinson, Jr. | 75/68 R |
| 3,660,076 | 5/1972 | Williams | 75/68 R |
| 3,737,305 | 6/1973 | Blayden | 75/68 R |
| 3,743,500 | 7/1973 | Floulard et al. | 75/93 E |
| 3,767,382 | 10/1973 | Bruno | 75/93 AC |

*Primary Examiner*—M. J. Andrews
*Attorney, Agent, or Firm*—Glenn, Lyne, Gibbs & Clark

[57] ABSTRACT

A process is set forth for reducing the aluminum carbide content of aluminum produced via carbothermic processes which comprises contacting the aluminum contaminated with aluminum carbide with reactive gases so as to cause the aluminum carbide to react and separate from the aluminum. The aluminum is recovered and the residue can be recycled back to the furnace without additional chemical treatment.

20 Claims, No Drawings

TREATMENT OF CARBOTHERMICALLY PRODUCED ALUMINUM

RELATION TO OTHER APPLICATIONS

This application is a continuation in part of Ser. No. 549,791, filed Feb. 13, 1975, now abandoned which is a continuation of Ser. No. 324,890, filed Jan. 18, 1973, now abandoned.

DESCRIPTION OF PRIOR ART

The production of aluminum by carbothermic processes has long been known in the art and there are numerous patents and literature articles which describe processes of this general type. A carbothermic process involves reacting an aluminum oxide containing compound with a reductant which is usually carbon aluminum carbide or a mixture thereof in an electric furnace so as to reduce the aluminum oxide to metallic aluminum. Although the reaction on first impression would appear to be a very simple one, i.e., the reduction of aluminum oxide to aluminum, the art has long been plagued with the inescapable fact that substantially pure aluminum is not obtained via conventional carbothermic processes and, in fact, the product which is tapped from the furnace is aluminum contaminated with aluminum carbide. The amount of contamination with aluminum carbide varies depending upon the particular carbothermic process which is carried out but, in general, conventional carbothermic processes result in the production of aluminum which is contaminated by 10–20% by weight of aluminum carbide.

As can well be appreciated, the present standards for commercially pure aluminum do not allow a significant quantity of aluminum carbide to be present and, as such, the furnace product from most carbothermic reduction processes has to be subjected to further processing steps in order to reduce the aluminum carbide content to an acceptable level. The art is well aware of a wide variety of processes which have been heretofore suggested by the workers in this art for reducing the aluminum carbide content from the product of a carbothermic reduction furnace and, in general, these processes have been time consuming, expensive, and evidently not economically feasible as is evidenced by the fact that there is no known commercial process practiced today for the preparation of commercially pure aluminum via a carbothermic reduction process.

One particular aspect to the problem of reducing the aluminum carbide content resides in the fact that the art has found out that it is relatively easy to reduce the aluminum carbide content of at least a portion of the aluminum produced by a carbothermic reduction process by simply letting the furnace melt cool so that an aluminum carbide matrix is formed whereby said aluminum carbide matrix squeezes out aluminum to the surface of the melt wherein this aluminum can be removed by any suitable technique, including decanting. The aluminum which is removed in this manner is greatly diminished in aluminum carbide content but only a small portion of the available aluminum is recovered.

It is also known to enhance the yield of aluminum from a carbothermic reduction process by utilizing a mechanical working. A technique of this type subjects moving equipment under severe stress to very hot and corrosive conditions.

There are also conventional techniques in the prior art such as fluxing with metallic salts which can diminish the amount of aluminum carbide contamination but the molten salts mix with the carbide so removed, and it is costly to remove the carbide from the salt so that the carbide can be recycled to the furnace. Without such recycle, the power consumption and furnace size become uneconomical in comparison with prior art methods practiced commercially for making aluminum.

DESCRIPTION OF THE PREFERRED EMBODIMENT

The novel process of this invention is carried out simply by contacting a mixture of aluminum contaminated with aluminum carbide in the molten state with certain gases which interact with or operate upon aluminum carbide so as to prevent the formation of an aluminum carbide matrix which would entrap the aluminum and recovering substantially pure aluminum. Treatment with the gases in accordance with techniques of this invention involve blowing the gas through the body of the melt of aluminum and aluminum carbide. This is conveniently accomplished by pouring the mixture of aluminum and aluminum carbide into a suitable receptacle which is provided with ports or inlets through which the particular reactive gas or mixture of gases is passed under pressure so that the gas passes through the body of the melt and reacts with the aluminum carbide. The number and size of the inlets is obviously not critical but what is required is that the gas pass through the body of the melt so as to be able to act upon the aluminum carbide and react therewith.

Another way of accomplishing the same is to cause a high velocity stream of gas to impinge upon and penetrate the aluminum-aluminum carbide mixture. Suitable examples of this technique include a plasma torch operating in an environment of air as well as the use of a lance.

It is to be understood that if a mixture of aluminum and aluminum carbide is simply heated in air so that the air only contacts the surface thereof that effective reduction of aluminum carbide content simply will not be obtained. This invention requires that the reactive gas be passed through the melt so that it has an opportunity to react with the aluminum carbide and prevent the formation of an aluminum-aluminum carbide matrix.

The gases that can be utilized in the novel process of this invention are not narrowly critical and they can be characterized by stating that they must include oxygen, for example in the form of air, carbon monoxide, carbon dioxide, or water vapor. It is to be understood that there can be other components in the gaseous mixture providing that oxygen and/or an oxidizing compound such as carbon monoxide, $CO_2$, or $H_2O$ are present. Thus, for example, the reactive gases can be mixtures of oxygen or carbon monoxide with inert gases such as nitrogen, argon, etc. Air would be useful in the instant process. In some cases the mixture of reactive gases can include materials such as chlorine or other halogens but in situations of this type it is extremely important that the concentration of the chlorine be controlled to low concentrations, i.e., no more than about 20 weight percent of the total mixture, in order to assure that the residue will be directly recyclible to the reduction furnace without additional chemical treatment. It is to be immediately understood that a treatment with 100 percent chlorine is not within the scope of this invention since the chlorine would react with the aluminum carbide and aluminum in such a manner as to produce products which cannot be directly recycled back to the furnace. An example of a mixture of a gas containing chlorine which is operable in the novel process of this invention would be a mixture of nitrogen, carbon monoxide and chlorine, wherein chlorine was about 10 weight percent of the total mixture.

The temperature at which the process of this invention is carried out is also not narrowly critical and all that is required is that it be carried out at a temperature which is sufficiently high to keep the aluminum-aluminum carbide mixture in a fluid state. The uppermost temperature is determined by the initial amount of aluminum carbide in solution with the aluminum. For example, with 20% $Al_4C_3$ in solution with aluminum the initial temperature of gassing must be about 2100°C. With an initial carbide content of 2%, the uppermost temperature can be as low as 1600°C. Quite obviously, excessively high temperatures should be avoided in order to prevent the aluminum from being lost to the atmosphere by volatilization. In general, it has been found that temperatures within the range of 660° to 2100°C and more preferably, from 700° to 1600°C can be effectively employed. The amount of gas which is used is also not narrowly critical and any convenient flow rate can be employed in order to obtain the desired results. It should appear quite obvious that, in general, a low flow rate will mean that the reaction will take longer to accomplish for the very simple reason that it will take longer for the gas to interact with the aluminum carbide and prevent the formation of the matrix. Additionally, too high a flow rate, although not detrimental to the reaction, will involve waste in that the gas will be passed through the mixture at a rate faster than it can react with the aluminum carbide which is present. Additionally, some gases are more effective than other gases so that the exact flow rate utilized would also depend on the particular gas which is being used. In general, however, it has been found that flow rates of from about 0.02 to about 5 liters per minute for each 100 grams of melt to be de-carbonized and, more preferably, from 0.04 to 0.06 liters per minute will be sufficient to accomplish the task of reducing the aluminum carbide contamination.

It is understood that gassing in accordance with this invention can be carried out at a substantially constant temperature, although, quite obviously, it is preferred to allow the aluminum-aluminum carbide melt to cool while gassing to within the temperature ranges above set forth.

It is also to be understood that the flow rate of gas need not be continuous but can rather be an intermittent operation if such is desired. Thus, gas can be charged at certain spaced intervals. This operation is within the scope of this invention. It is also to be understood that the flow rate of gas used may not be a constant one, but can be raised and lowered as conditions require.

The time during which the novel process of this invention is carried out is also not narrowly critical and, quite obviously, it is carried out until the amount of aluminum carbide is decreased to acceptable levels. Factors which govern the amount of time with which the reaction is carried out obviously include the flow rate of the oxidizing gas being utilized, as well as the temperature and the amount of carbide contamination. It is quite obvious, however, that sampling techniques can easily determine when the reaction has progressed to the point that the aluminum carbide contamination has been reduced to desired levels.

The manner in which the reactive gas or gases affects the aluminum carbide is not completely understood but it has been observed that when aluminum contaminated with aluminum carbide is contacted in accordance with the novel process of this invention, the aluminum carbide is changed so that it becomes readily separable from the aluminum. This change is evidenced by the fact that the aluminum carbide separates from the aluminum product — usually in the form of a foam-like material which can be removed from the aluminum mass by any conventional technique including skimming and/or decantation.

One particularly significant advantage of the instant process is that the reaction product, containing aluminum carbide, for example, the foam previously referred to can be directly recycled back to the reduction furnace without additional chemical treatment. This advantage is of tremendous importance since as can be readily appreciated, additional chemical treatments are expensive and time consuming which detract from the overall economy of any operation. This is to be immediately distinguished from the heretofore practiced prior art processes involving the use of fluxes wherein the residue after removal of aluminum was not, could not, be recycled directly back to reduction furnaces without expensive chemical treatment.

A particularly preferred embodiment of the novel process of this invention resides in those situations wherein the aluminum being treated is contaminated with no more than about 5 weight percent of aluminum carbide. It has been found that when a feed material containing this percentage of aluminum carbide is treated in accordance with the novel process of this invention, the aluminum carbide is changed to a readily separable form and aluminum can be recovered which meets the specifications of commercially pure aluminum.

EXAMPLE 1

A mixture of 186.88 grams of aluminum contaminated with 3.12 grams of aluminum carbide (1.64 weight percent aluminum carbide) was melted and while in the molten state fluxed with Tri-gas* at a flow rate of 0.5 liters per minute for 10 minutes. The temperature during this time was 1045°C. After the treatment for 10 minutes, the metal was poured off and analyzed for aluminum carbide content.

*Tri-gas — 80 Vol. % Nitrogen
— 10 Vol. % Chlorine
— 10 Vol. % Carbon Monoxide

The aluminum carbide level was so low that it was below detection limits, i.e., less than 0.2%. A sample of unfluxed electrolytic metal showed 0.2% aluminum carbide by the same test.

EXAMPLE 2

A charge of 401 grams of aluminum and 8 grams of aluminum carbide (about 2 weight percent aluminum carbide) was heated to 1510°C. and homogenized by stirring. Air was blown through the melt at 0.6 liters per minute for four minutes.

The sample was cooled to 1100°C and skimmed. Air was again blown at 0.7 liters per minute for 1 minute. The melt was skimmed and allowed to freeze.

Analysis of the product showed that the aluminum carbide content had been reduced to 0.73 weight percent.

EXAMPLE 3

A charge of 4474 grams of aluminum and 44 grams of carbon fines (enough to produce about 4 weight percent aluminum carbide) was heated to 1740°C and homogenized by stirring. Carbon dioxide gas was blown through the melt at approximately 2 liters per minute for 32 minutes at which time the melt was at 1000 ±25°C.

The melt container was tipped to a horizontal position and 665 grams of product was poured out. This was a pourable yield, at approximately 1000°C, of 14.7 percent of the starting material.

Analysis of the poured product showed that the aluminum carbide content was reduced to 0.89 weight percent.

EXAMPLE 4

A charge of 4452 grams of aluminum and 44 grams of carbon (enough to produce about 4 weight percent aluminum carbide) was heated to 1910°C and homogenized by stirring. Carbon dioxide gas was blown through the melt at approximately 2 liters per minute for 3 minutes at which time the melt was at 1000 ±25°C.

The melt container was tipped to a horizontal position and 400 grams of product was poured out. This was a pourable yield, at approximately 1000°C, of 8.9 percent of the starting material.

Analysis of the poured product showed that the aluminum carbide content was reduced to 0.44 weight percent.

EXAMPLE 5

A charge of 4452 grams of aluminum and 44 grams of carbon fines (enough to produce about 4 weight percent aluminum carbide) was heated to 1810°C and homogenized by stirring. Water vapor gas (steam) was blown through the melt at approximately 2 liters per minute for 15 minutes at which time the melt was at 1000 ±25°C.

The melt container was tipped to a horizontal position and 1159 grams of product was poured out. This was a pourable yield, at approximately 1000°C, of 25.7 percent of the starting material.

Analysis of the poured product showed that the aluminum carbide content was reduced to 1.26 weight percent.

EXAMPLE 6

A charge of 4425 grams of aluminum and 44 grams of carbon fines (enough to produce about 4 weight percent aluminum carbide) was heated to 1765°C and homogenized by stirring. Water vapor gas (steam) was blown through the melt at approximately 2 liters per minute for 10 minutes at which time the melt was at 1075°C.

The melt container was tipped to a horizontal position and 1577 grams of product was poured out. This was a pourable yield, at approximately 1000°C, of 35.3 percent of the starting material.

Analysis of the poured product showed that the aluminum carbide content was reduced to 1.43 weight percent.

EXAMPLE 7

A charge of 4489 grams of aluminum and 44 grams of carbon fines (enough to produce about 4 weight percent aluminum carbide) was heated to 1730°C and homogenized by stirring. Carbon monoxide (85%) - chlorine (15%) gas mix* was blown through the melt at approximately 2 liters per minute for 12 minutes at which time the melt was at 1000 ±25°C.

* Volume Percent

The melt container was tipped to a horizontal position and 658 grams of product was poured out. This was a pourable yield, at approximately 1000°C, of 14.5 percent of the starting material.

Analysis of the poured product showed that the aluminum carbide content was reduced to 0.79 weight percent.

EXAMPLE 8

A charge comprising aluminum contaminated with 3 weight percent of aluminum carbide is subjected to the action of a plasma torch in an environment of air such that the charge is flowable at approximately 900°C. A residue comprising alumina, aluminum carbide and aluminum is skimmed, approximately 60% of the weight of the charge is recovered as pourable aluminum containing less than 0.2% aluminum carbide.

What is claimed is:

1. A process for decreasing aluminum carbide contamination of aluminum produced by carbothermic processes, said process comprising:

A. preparing said aluminum contaminated with up to 20 weight percent of aluminum carbide as a melt at an initial temperature sufficiently high to keep said melt in a fluid state;

B. blowing said melt with a gas which comprises oxygen, air, carbon dioxide, steam, carbon monoxide, or a mixture of chlorine, nitrogen, and carbon monoxide, wherein chlorine is present in an amount no greater than about 20 weight percent, or mixtures of these gases for a sufficient period of time to prevent the formation of an aluminum-aluminum carbide matrix, whereby said aluminum carbide becomes readily separable from said aluminum;

C. separating said aluminum carbide from said aluminum in said melt.

2. The process of claim 1 wherein said gas consists essentially of oxygen or air.

3. The process of claim 1 wherein said gas consists essentially of steam.

4. The process of claim 1 wherein said gas consists essentially of carbon dioxide.

5. The process of claim 1 wherein said gas consists essentially of carbon monoxide.

6. The process of claim 1 wherein said gas is a mixture of chlorine, nitrogen, and carbon monoxide, wherein chlorine is present in an amount no greater than about 20 weight percent.

7. The process of claim 1 wherein said initial temperature varies directly with the initial amount of said aluminum carbide contamination.

8. The process of claim 7 wherein said initial temperature is about 1500°C when said initial amount is 2%.

9. The process of claim 1 wherein said blowing is at a flow rate for said reactive gas of from about 0.02 to about 5 liters per minute for each 100 grams of said melt.

10. The process of claim 9 wherein said flow rate is from 0.04 to 0.06 liters per minute for each 100 grams of said melt.

11. The process of claim 1 wherein said separated aluminum carbide is recycled directly back to a reduction furnace without additional chemical treatment.

12. The process of claim 1 wherein said contamination is no more than about 5 weight percent of said aluminum carbide.

13. The process of claim 1 wherein said preparing of said melt comprises pouring said aluminum contaminated with said aluminum carbide into a receptacle which is provided with inlets through which said gas is passed under pressure so that said gas passes through the body of said melt.

14. In a carbothermic process for producing aluminum in an electric furnace by reacting an aluminum-oxygen compound with a carbon-containing reductant to produce a mixture of aluminum and aluminum carbide which solidifies as an aluminum-aluminum carbide matrix while cooling, the improvement comprising:

A. while said mixture is a melt in a fluid state at an uppermost temperature determined by an initial amount that is no greater than 5% by weight of said aluminum carbide admixed with said aluminum, sufficiently removing said aluminum carbide from said mixture and reducing said initial amount so that said aluminum remaining therein is substantially pure, said removing comprising the steps of:

1. passing a gas which consists essentially of oxygen, air, steam, carbon monoxide, carbon dioxide, or a mixture of chlorine, nitrogen, and carbon monoxide, wherein chlorine is present in an amount no greater than about 20 weight percent, for a sufficient period of time to prevent the formation of an aluminum-aluminum carbide matrix, whereby said aluminum carbide separates to the surface of said melt, and
2. skimming said separated aluminum carbide from the said surface, and B. recycling said skimmed aluminum carbide directly back to said electric furnace without additional chemical treatment.

15. The process of claim 14 wherein said gas consists essentially of air or oxygen.

16. The process of claim 14 wherein said gas consists essentially of steam.

17. The process of claim 14 wherein said gas consists essentially of carbon dioxide.

18. The process of claim 14 wherein said gas consists essentially of carbon monoxide.

19. The process of claim 1 wherein said gas consists essentially of a mixture of carbon monoxide and chlorine.

20. The process of claim 14 wherein said gas consists essentially of a mixture of carbon monoxide and chlorine.

* * * * *